US011248875B2

(12) United States Patent
Evans

(10) Patent No.: US 11,248,875 B2
(45) **Date of Patent: *Feb. 15, 2022**

(54) ADJUSTABLE POSITION MAGAZINE CARRIER

(71) Applicant: Edge-Works Manufacturing Company, Burgaw, NC (US)

(72) Inventor: Scott V. Evans, Jacksonville, NC (US)

(73) Assignee: Edge-Works Manufacturing Company, Burgaw, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/108,047

(22) Filed: Dec. 1, 2020

(65) Prior Publication Data

US 2021/0080223 A1 Mar. 18, 2021

Related U.S. Application Data

(63) Continuation of application No. 16/511,327, filed on Jul. 15, 2019, now Pat. No. 10,883,796.

(60) Provisional application No. 62/697,636, filed on Jul. 13, 2018.

(51) Int. Cl.
*F41C 33/04* (2006.01)

(52) U.S. Cl.
CPC ..... *F41C 33/045* (2013.01)

(58) Field of Classification Search
CPC ..... F41C 33/04; F41C 33/045
USPC ..... D3/222; D8/354, 355, 366; 248/300; 224/271, 272, 192, 193, 198, 931, 911, 224/912
See application file for complete search history.

(56) References Cited

U.S. PATENT DOCUMENTS 2,884,670 A * 5/1959 Garrison ..... E04B 1/2608 403/388
D313,338 S * 1/1991 Rasmussen ..... D8/356
5,018,653 A * 5/1991 Shoemaker ..... F41C 33/0227 224/193
5,111,545 A * 5/1992 Krozal ..... A47C 21/00 224/675
5,292,171 A * 3/1994 Harrell ..... B60N 2/757 297/113
D359,439 S * 6/1995 Osbern ..... D8/354
5,421,497 A * 6/1995 Gilmore ..... A45F 5/00 224/192
5,551,611 A * 9/1996 Gilmore ..... A45F 5/00 224/192
D391,915 S * 3/1998 Miller ..... D12/223
5,875,944 A * 3/1999 Beletsky ..... F41C 33/041 224/198
D418,393 S * 1/2000 Proctor ..... D8/354
6,010,045 A * 1/2000 Rogers ..... F41C 33/041 224/197
D453,068 S * 1/2002 Rogers ..... D3/222
6,588,640 B1 * 7/2003 Rogers ..... A45F 5/021 224/192

(Continued)

*Primary Examiner* — Justin M Larson
(74) *Attorney, Agent, or Firm* — Stephen M. Kepper; Intellectual Property Consulting, LLC

(57) ABSTRACT

A solid mounting plate for attaching a magazine carrier, or other accessory, to a holster to provide stability for the mounted accessory while also allowing variable positioning of the accessory carrier with respect to the holster to increase user comfort and reduce stress placed on the holster by the accessory carrier.

10 Claims, 7 Drawing Sheets

(56) References Cited

U.S. PATENT DOCUMENTS 6,755,331 B2 * 6/2004 Rassias ..... F41C 33/0227 224/193
7,204,395 B2 * 4/2007 Gallagher ..... A45F 5/02 224/192
7,320,420 B2 * 1/2008 Buis ..... F41C 33/02 224/192
D567,707 S * 4/2008 Yeates ..... D11/200
D571,640 S * 6/2008 Misch ..... D8/354
7,461,765 B2 * 12/2008 French ..... F41C 33/0227 224/243
D596,015 S * 7/2009 Scarcello ..... D8/354
D601,339 S * 10/2009 Zusman ..... D3/222
7,690,541 B2 * 4/2010 Pellegrini ..... F41C 33/045 224/198
D618,085 S * 6/2010 Lin ..... D8/354
7,971,762 B2 * 7/2011 Clifton, Jr. ..... A45F 5/02 224/197
8,226,061 B2 * 7/2012 Nehls ..... F24S 25/33 248/300
8,297,562 B1 * 10/2012 Yeates ..... A45F 5/02 248/118.3
D685,253 S * 7/2013 Hiebert ..... D8/354
8,783,532 B2 * 7/2014 Gregory ..... F41C 33/045 224/198
D732,932 S * 6/2015 Ng ..... D8/354
9,360,276 B1 * 6/2016 Meek ..... F41C 33/04
9,541,349 B2 * 1/2017 Benton ..... F41C 33/04
D787,916 S * 5/2017 Yuan ..... D8/354
D796,938 S * 9/2017 Rago ..... D8/354
9,957,709 B2 * 5/2018 Kempf ..... E04C 3/04
D824,748 S * 8/2018 Needel ..... D8/354
D860,642 S * 9/2019 Dara ..... D3/222
D887,706 S * 6/2020 Evans ..... F41C 33/041 D3/222
D888,540 S * 6/2020 Cheng ..... D8/354
10,883,796 B2 * 1/2021 Evans ..... F42B 39/02
2010/0243690 A1 * 9/2010 Lerch ..... A45F 5/02 224/198
2014/0027486 A1 * 1/2014 McGee ..... F41C 33/048 224/587
2015/0192388 A1 * 7/2015 Blach ..... F41C 33/041 224/660
2016/0231081 A1 * 8/2016 Evans ..... F41C 33/041
2017/0100847 A1 * 4/2017 Benton ..... B26B 29/025
2020/0018568 A1 * 1/2020 Evans ..... F41C 33/04
2020/0116455 A1 * 4/2020 Haggart ..... F42B 39/02
2021/0025671 A1 * 1/2021 Moultrie ..... F41C 33/0236
2021/0080223 A1 * 3/2021 Evans ..... F41C 33/045

* cited by examiner

ADJUSTABLE POSITION MAGAZINE CARRIER

RELATED APPLICATIONS

This application is a continuation of U.S. patent application Ser. No. 16/511,327, filed Jul. 15, 2019, which claims priority to U.S. Provisional Application No. 62/697,636 filed Jul. 13, 2018. The entire contents of the above applications are hereby incorporated by reference as though fully set forth herein.

FIELD

The present invention relates to the field of devices designed for the holding of tactical gear. More specifically, the present invention relates to devices designed to attach accessories to the gun holster of a user.

BACKGROUND

Holsters are devices that are used to hold, carry and/or restrict the movement of a weapon, such as a handgun, and they are most commonly in a location where the weapon can be withdrawn for immediate use. Holsters typically have mounting points that enable accessories to be attached directly to the holster for items such as clips for the belt, belt loops, paddles, and modular, lightweight, load-carrying equipment (MOLLE) adaptors for attaching various types of gear. These mounting positions typically do not have a solid surface and therefore lack stability for the attachment of many accessories. Furthermore, positioning of these accessories is typically limited to the holster mounting point locations, which are usually around the edges of the holster and only allows one set mounting position.

Additionally, the best location and position of the accessories, such as a magazine carrier, as related to the user is variable depending on several factors. Among these are the body type of the user, training background of the user, intended mission, operational environment, and a consideration of other gear that may or may not be necessary for the user to carry on person at the same time as the holster. Taken together the greater the range of adjustment and options in mounting and positioning of the accessory the more likely the user is able to incorporate the weapon and accessory in an orientation that is most effective for the intended purpose. The present invention substantially expands the user's options, in a way not possible without use of the present invention, for mounting, attaching and carrying an accessory such as a magazine carrier with the holstered weapon.

BRIEF SUMMARY OF THE INVENTION

The present invention provides a solid mounting plate for attaching a magazine carrier, or other comparable accessory, to a holster. The present invention further allows for variation in magazine carrier positioning with respect to the holster. Elevation of the mounting surface can also be an advantage as it reduces substantially the stresses that are placed on, and to, the surface geometry or shape of the holster when the magazine carrier is attached directly to the surface of the holster. Such stress negatively affects the fit and retention qualities of a holster by deforming or warping the intended surface shape of the holster exteriors. The present invention reduces this effect or eliminates it completely as it elevates the mounted magazine carrier above the form-fitting surface of the holster. As such, the present invention allows direct attachment of the magazine carrier, or other accessories, to the holster in a location where the holster is structurally suited for the stress associated with mounting while enabling positioning of the accessory to be in the most ideal location and orientation for the task. The present invention allows for pivoting of the accessory holder away from the vertical plane of the holster up to about 35 degrees.

BRIEF DESCRIPTION OF THE DRAWINGS

FIG. 1 is a top view of the mounting plate of the present invention.

FIG. 2 is a side view of the mounting plate of the present invention.

FIG. 3A is a side view of the present invention showing a variety of adjustable mounting positions for the magazine carrier with the magazine carrier and mounting plate parallel to the holster prominent.

FIG. 3B is a side view of the present invention showing a variety of adjustable mounting positions for the magazine carrier with the magazine carrier and mounting plate angled away from the vertical plane of the holster prominent.

FIG. 4 is a side view of the present invention in one of the variety of adjustable mounting positions on the holster.

FIG. 5 is a side view of the present invention in one of the variety of adjustable mounting positions on the holster.

FIG. 6 is an opposing side view of the present invention in the adjustable mounting position shown in FIG. 5.

FIG. 7 is a side view of the present invention in one of the variety of adjustable mounting positions on the holster.

DETAILED DESCRIPTION

Figure 1:
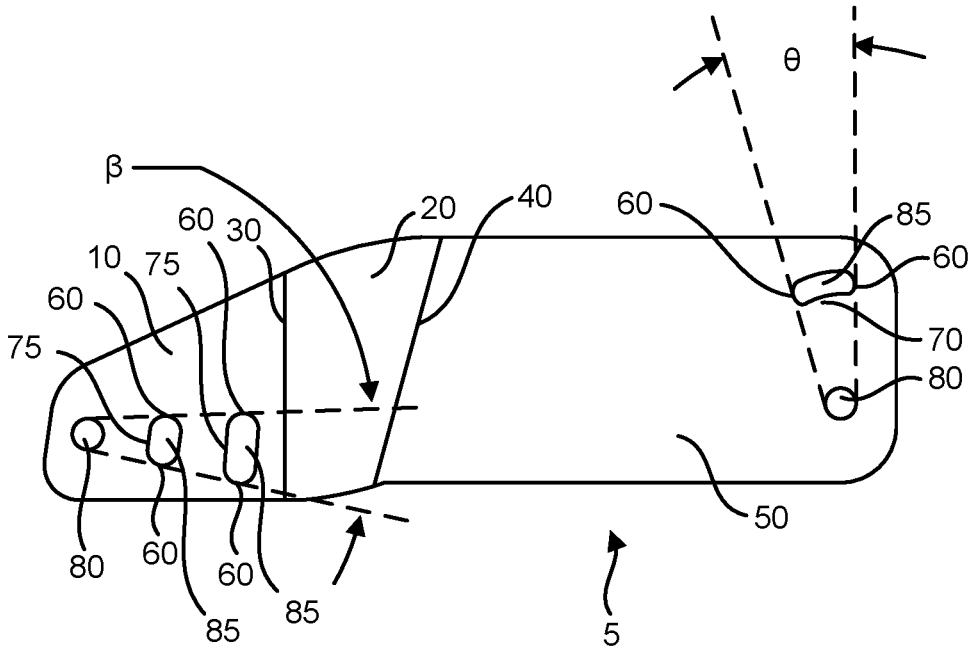
FIG. 1.
Figure 2:
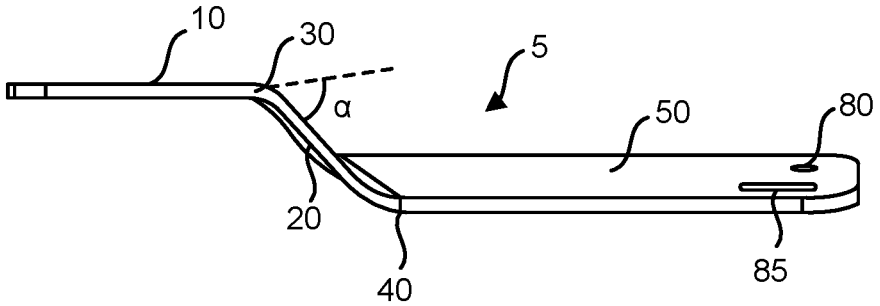
FIG. 2.
Figure 3A:
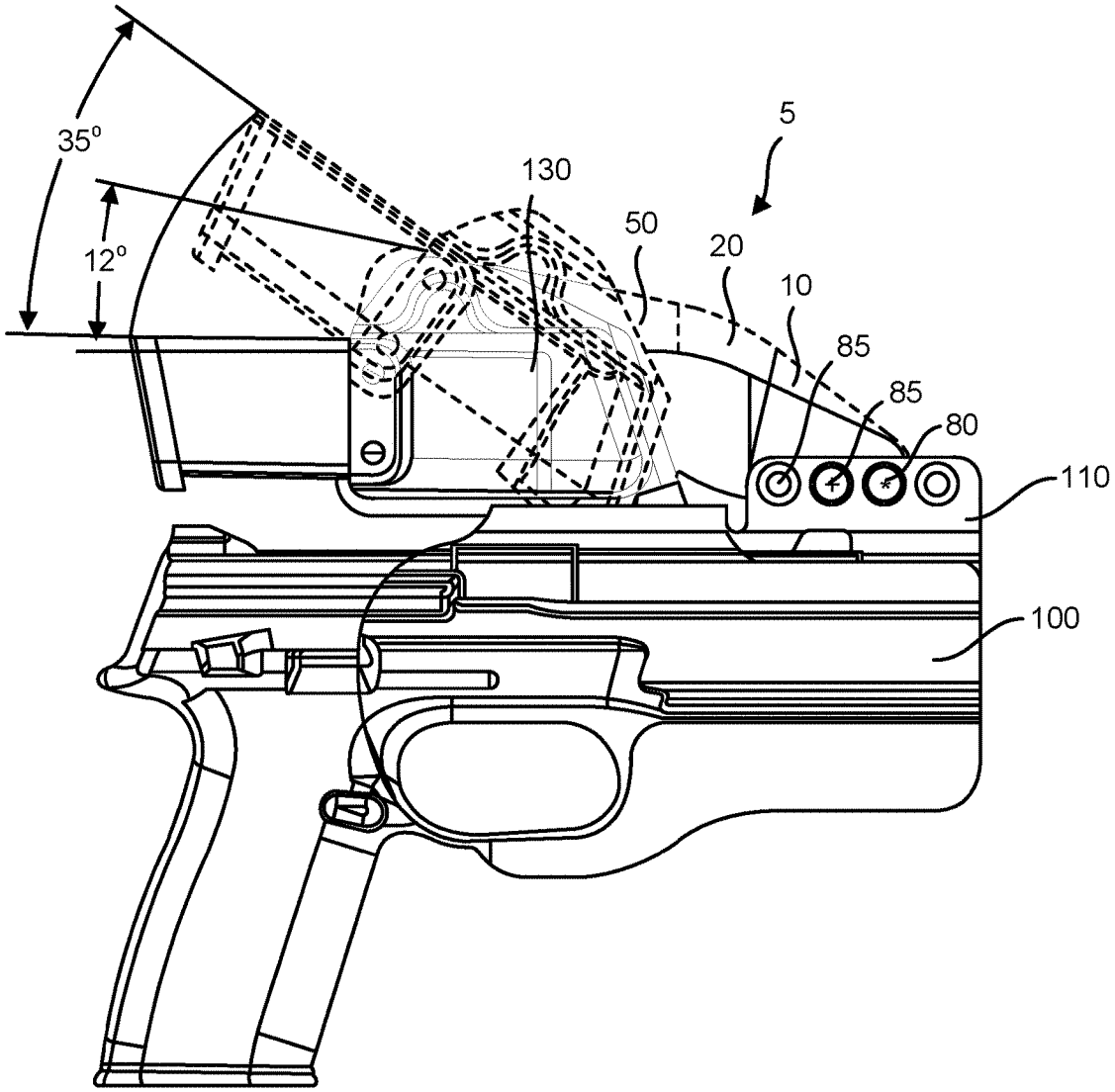
FIG. 3A.
Figure 3B:
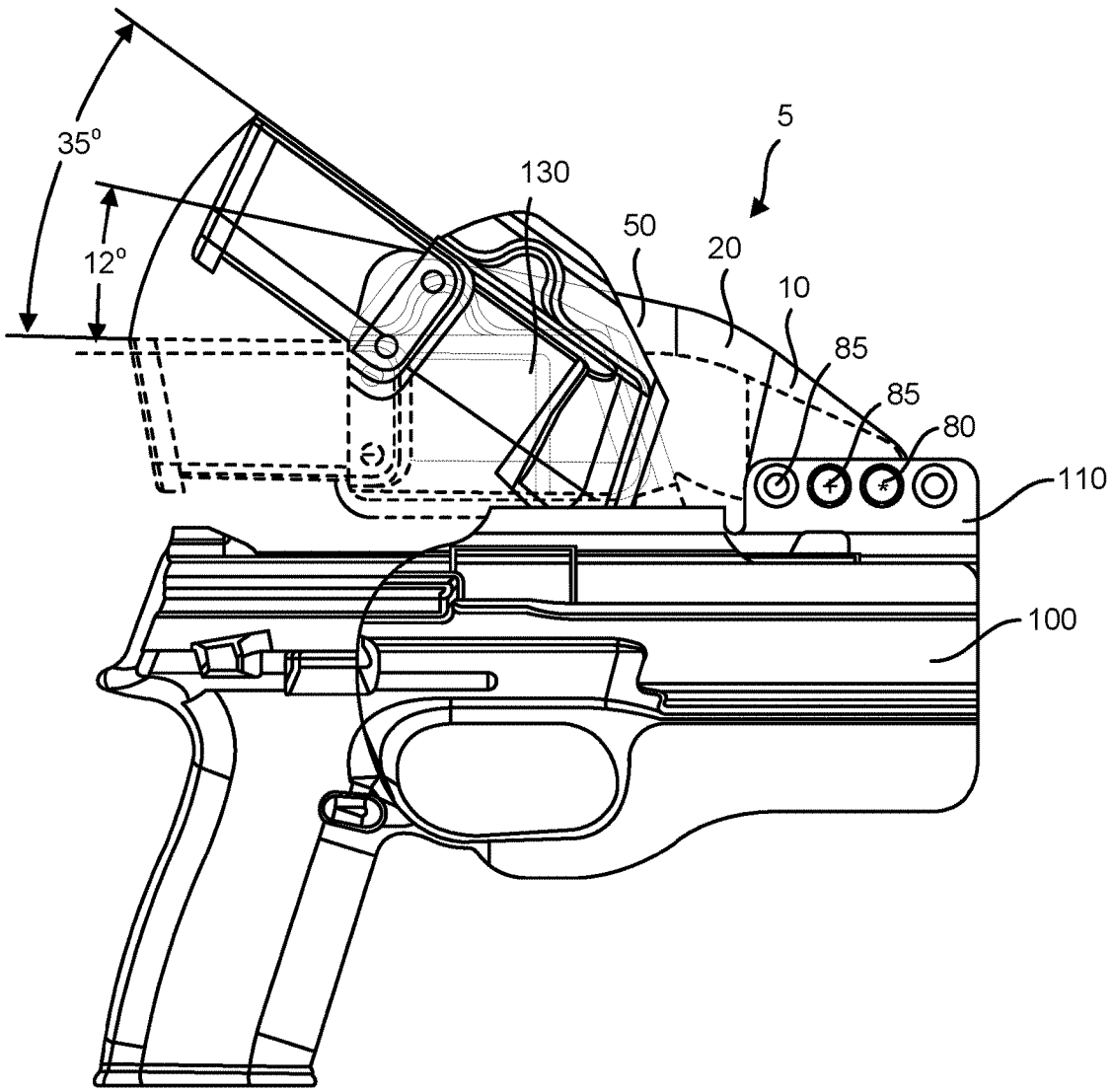
FIG. 3B.
Figure 4:
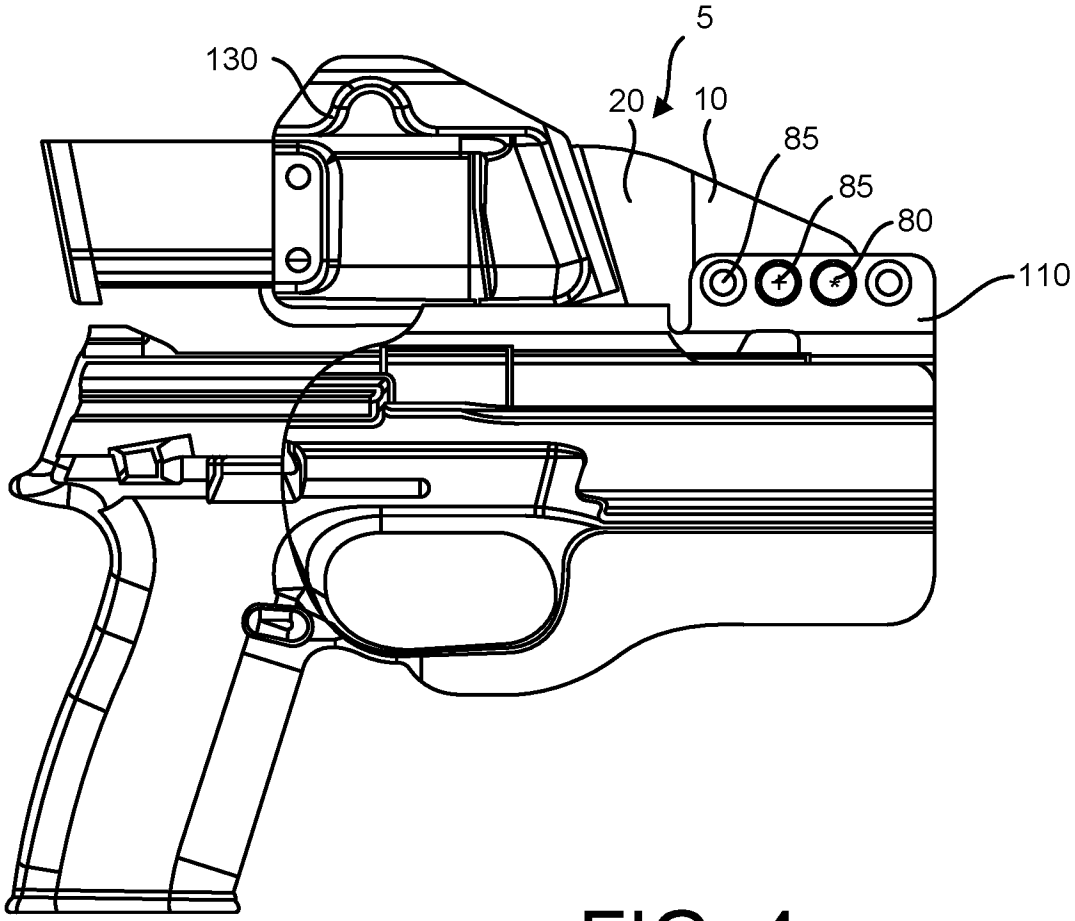
FIG. 4.
Figure 5:
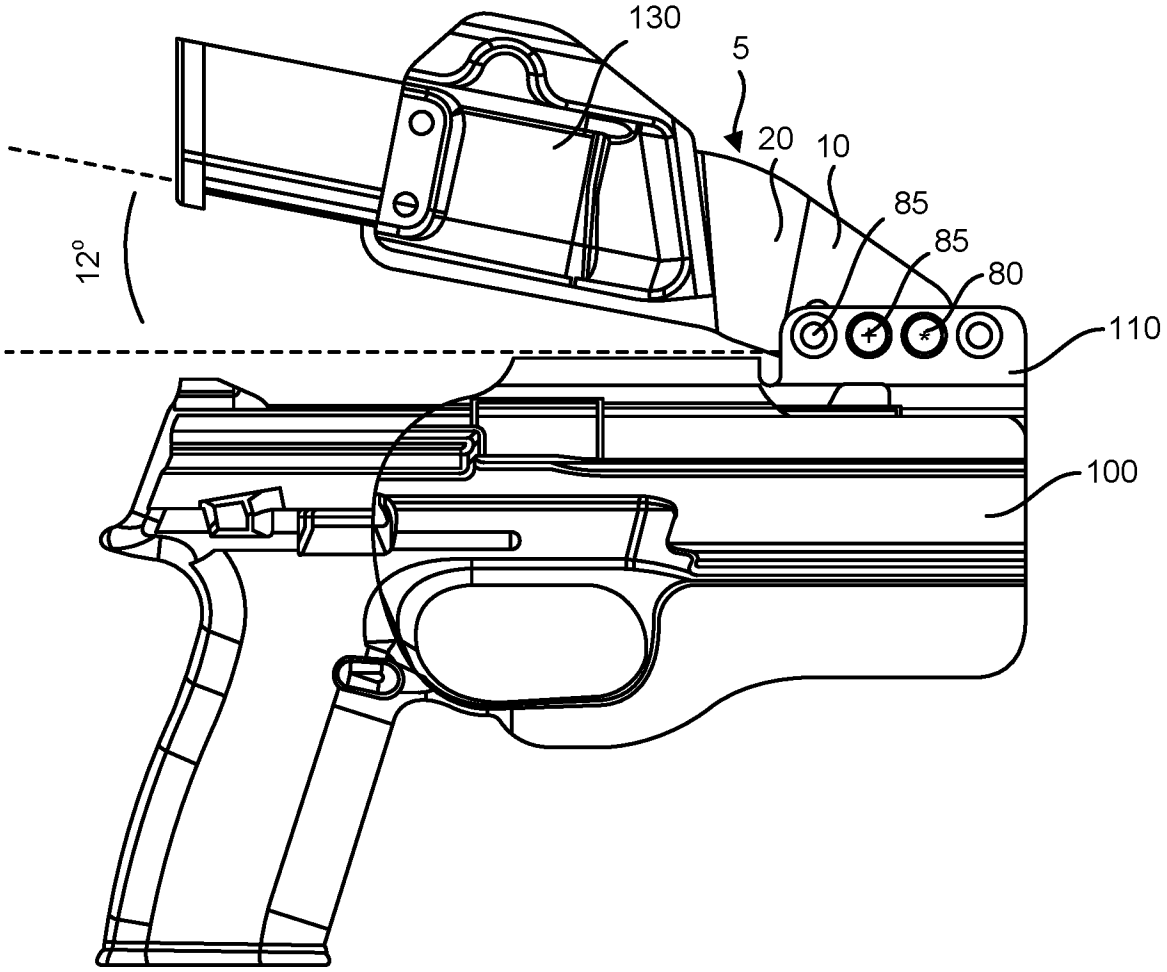
FIG. 5.

Turning to FIGS. 1 and 2, the preferred embodiment of the mounting plate 5 of the present invention is shown. The mounting plate 5 comprises a first planar surface 10, a middle planar surface 20 having a proximal end 30 and a distal end 40, and a second planar surface 50 wherein the first planar surface 10 attaches to the proximal end 30 of the middle planar surface 20 and the second planar surface 50 attaches to the distal end 40 of the middle planar surface 20. This patent anticipates various configurations of the planar surfaces in relation to each other. For example, all three planar surfaces 10, 20, 50 may aligned in the same continuous plane, or alternatively, the first planar surface 10 may be slightly offset from the second planar surface 50 by a vertical bend equal to angle $\alpha$ (as shown in FIG. 1) up to 13° in relation to the horizontal plane of the first planar surface 10.

The first planar surface 10 and second planar surface 50 further comprise a plurality of mounting apertures used to attach the mounting plate 5 to other accessories, such as a holster 100 and a magazine carrier 130 as depicted in FIGS. 3-7. As shown in FIG. 1, the first planar surface 10 has at least one anchor aperture 80 and at least one adjustable aperture 85 positioned in series in a horizontal direction towards the proximal end 30 of the middle planar surface 20. The vertical height 75 of each adjustable aperture 85 in series increases towards the proximal end 30 of the middle planar surface 20 such that one side 60 of each adjustable aperture 85 is substantially axially aligned with the anchor aperture 80 and the opposing side 60 of each adjustable aperture 85 is offset from the anchor aperture 80 by a first accessory angle β.

Additionally, as shown in FIG. 1, the second planar surface 50 has at least one anchor aperture 80 and at least one adjustable aperture 85 positioned in series in a vertical direction along the second planar surface 50. The width 70 of each adjustable aperture 85 in series increases such that one side 60 of the adjustable aperture 85 is substantially axially aligned with the anchor aperture 80 and the opposing side 60 of the adjustable aperture 85 is offset by a second accessory angle θ.

As shown in FIGS. 3-7, fasteners, e.g. screws, may be used to secure the mounting plate 5 to a holster 100 through a dedicated attachment tab 110 by threading the screw through the anchor aperture 80 and the adjustable aperture(s) 85 on the first planar surface 10. Adjustable aperture(s) 85 allow the mounting plate 5 to be secured at various position with respect to the vertical plane of the holster 100; specifically, mounting plate 5 and magazine carrier 130 may pivot around the anchor aperture 80 up to the first accessory angle β away from the vertical plane of the holster 100. For the preferred embodiment, first accessory angle β ranges from 0° to 12°.

Figure 6:
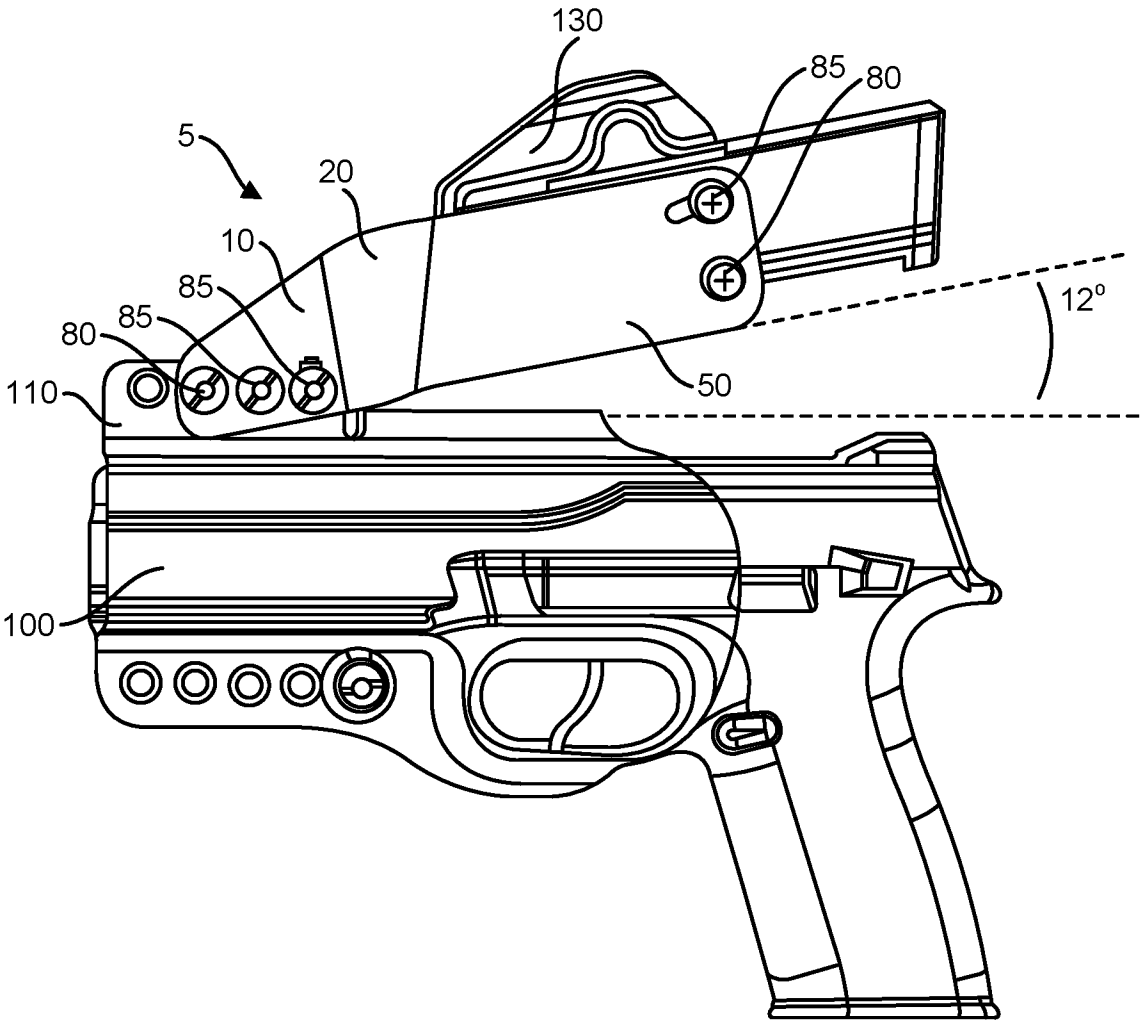
FIG. 6.

Similar fasteners or screws may be used to attach the bracket 5 to an accessory, such as a magazine carrier 130, by threading the screw through the anchor aperture 80 and the adjustable aperture(s) 85 on the second planar surface 50 (as shown in FIG. 6). Adjustable aperture(s) 85 allow for the magazine carrier 130 to be secured at various positions with respect to the mounting plate 5; specifically, the magazine carrier 130 may pivot around the anchor aperture 80 in a circumferential direction up to the second accessory angle θ away from the vertical plane of the second planar surface 50. For the preferred embodiment, the second accessory angle θ ranges from 0° to 25°.

Figure 7:
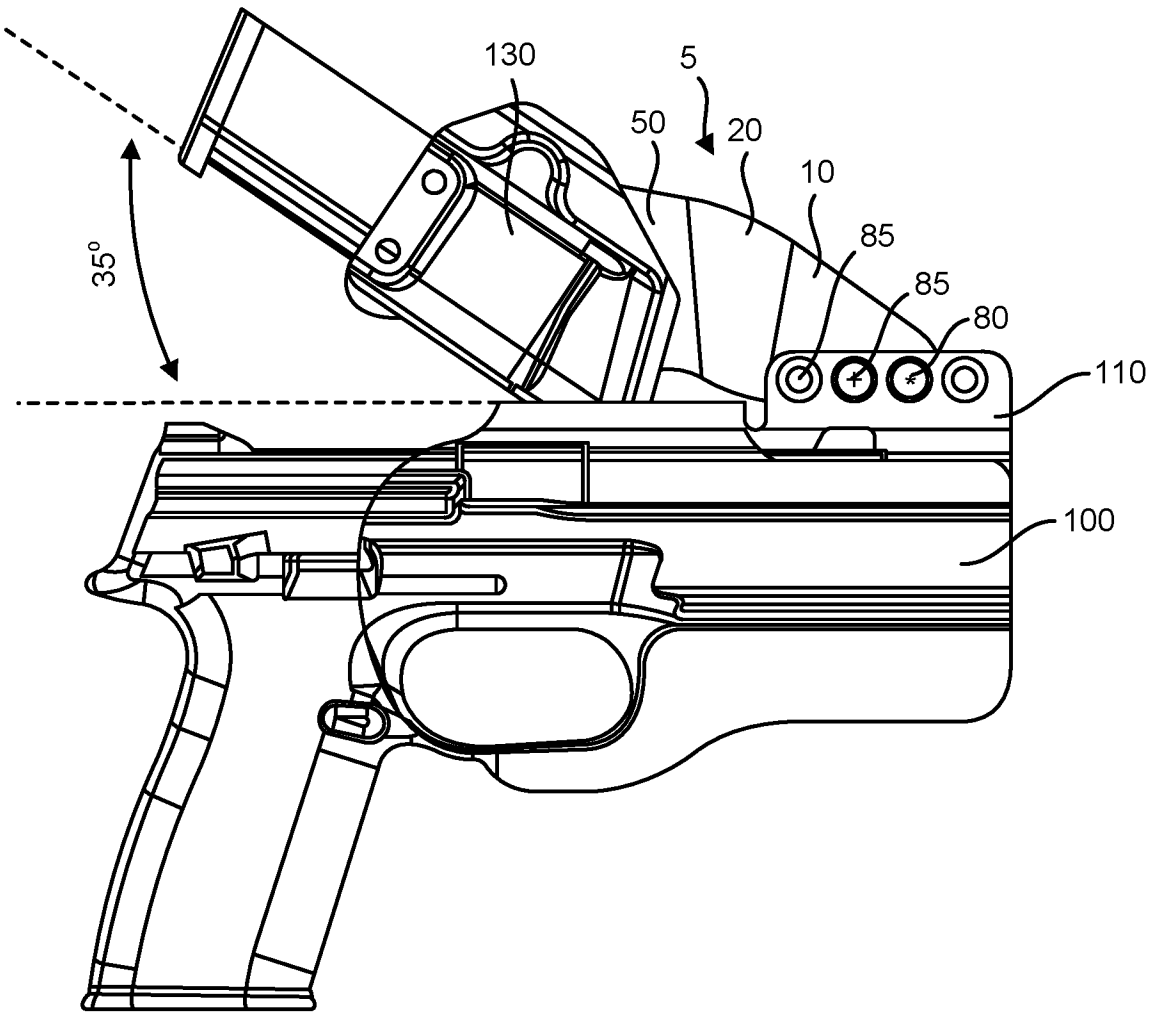
FIG. 7.

Turning to FIG. 7, for purposes of this invention, when both angles β and θ are at their optimal maximum, the magazine carrier 130 may be rotatably adjusted up to 35° from the vertical plane of the holster 100.

For the purposes of promoting an understanding of the principles of the invention, reference has been made to the preferred embodiments illustrated in the drawings, and specific language has been used to describe these embodiments. However, this specific language intends no limitation of the scope of the invention, and the invention should be construed to encompass all embodiments that would normally occur to one of ordinary skill in the art. The particular implementations shown and described herein are illustrative examples of the invention and are not intended to otherwise limit the scope of the invention in any way. For the sake of brevity, conventional aspects of the method (and components of the individual operating components of the method) may not be described in detail. Furthermore, the connecting lines, or connectors shown in the various figures presented are intended to represent exemplary functional relationships and/or physical or logical couplings between the various elements. It should be noted that many alternative or additional functional relationships, physical connections or logical connections might be present in a practical device. Moreover, no item or component is essential to the practice of the invention unless the element is specifically described as "essential" or "critical". Numerous modifications and adaptations will be readily apparent to those skilled in this art without departing from the spirit and scope of the present invention.

What is claimed is:

1. An assembly for mounting a magazine carrier to a holster, said assembly comprising:

a holster having a dedicated attachment tab;

a magazine carrier having a dedicated attachment portion;

a mounting plate comprising at least two first accessory mounting apertures operable to attach to the dedicated attachment tab of the holster at a first accessory angle, wherein the first accessory mounting apertures are operable to adjust the first accessory angle, and at least two second accessory mounting apertures operable to attach to the attachment portion of the magazine carrier at a second accessory angle, wherein the second accessory mounting apertures are operable to adjust the second accessory angle.

2. The assembly of claim 1 wherein the mounting plate comprises a first planar surface, a second planar surface, and a middle planar surface, wherein the first planar surface is offset from the second planar surface by an offset angle between the middle planar surface and the horizontal plane of the first planar surface.

3. The assembly of claim 1 wherein said first accessory mounting apertures comprise at least one anchor aperture and one adjustable aperture.

4. The assembly of claim 3 wherein said anchor aperture and adjustable aperture of said first accessory mounting apertures are positioned in series.

5. The assembly of claim 4 further comprising at least one additional adjustable aperture for said first accessory mounting apertures, wherein said additional adjustable aperture is positioned above said other adjustable aperture such that the adjustable apertures are operable to adjust the first accessory angle between a first position and a second position.

6. The assembly of claim 4 wherein the adjustable aperture of said first accessory mounting aperture comprises a height such that the adjustable aperture in series has a greater height than the anchor aperture immediately preceding it.

7. The assembly of claim 1 wherein said second accessory mounting apertures comprise at least one anchor aperture and one adjustable aperture.

8. The assembly of claim 7 wherein the anchor aperture and the adjustable aperture of said second accessory mounting apertures are positioned in series.

9. The assembly of claim 8 further comprising at least one additional adjustable aperture for said second accessory mounting apertures, wherein said additional adjustable aperture is positioned above said other adjustable aperture such that the adjustable apertures are operable to adjust the second accessory angle between a first position and a second position.

10. The assembly of claim 8 wherein the adjustable aperture of said second accessory mounting aperture comprises a height such that the adjustable aperture in series has a greater height than the anchor aperture immediately preceding it.

* * * * *